US006061225A

United States Patent [19]

Nojima

[11] Patent Number: 6,061,225

[45] Date of Patent: May 9, 2000

[54] METHOD AND APPARATUS FOR CONTROLLING A SOLENOID WITHIN AN ELECTRIC DISPENSING GUN

[75] Inventor: Geraldo Nojima, Duluth, Ga.

[73] Assignee: Nordson Corporation, Westlake, Ohio

[21] Appl. No.: 09/304,490

[22] Filed: May 3, 1999

[51] Int. Cl.[7] ..... H01H 9/00

[52] U.S. Cl. ..... 361/160; 361/154

[58] Field of Search ..... 361/152–156, 361/160

[56] References Cited

U.S. PATENT DOCUMENTS

| | | | |
|---|---|---|---|
| 4,399,483 | 8/1983 | Phelan . | |
| 4,453,652 | 6/1984 | Merkel et al. . | |
| 4,665,348 | 5/1987 | Stupak, Jr. | 361/154 |
| 4,718,454 | 1/1988 | Appleby | 361/156 |
| 4,904,919 | 2/1990 | McNaughton . | |
| 5,375,738 | 12/1994 | Walsh et al. . | |
| 5,666,286 | 9/1997 | Nojima et al. . | |
| 5,812,355 | 9/1998 | Nojima . | |

*Primary Examiner*—Fritz Fleming
*Attorney, Agent, or Firm*—Wood, Herron & Evans

[57] ABSTRACT

A driver circuit is provided to control current flow through a solenoid coil of an electric liquid dispensing device including a valve element and a dispensing orifice. The driver circuit includes a bidirectional current source coupled to the solenoid coil for applying current in opposite directions through the coil. In a forward current direction, a magnetic attraction is created between the solenoid coil and the valve element to retract the valve element from the dispensing orifice. In a reverse current direction, a magnetic repulsion is created between the solenoid coil and the valving element to force the valving element toward the dispensing orifice. The magnetic flux generated in the solenoid coil by the forward current is calculated, and the reverse current is applied to substantially demagnetize the solenoid.

12 Claims, 3 Drawing Sheets

METHOD AND APPARATUS FOR CONTROLLING A SOLENOID WITHIN AN ELECTRIC DISPENSING GUN

FIELD OF THE INVENTION

The present invention relates generally to material dispensing systems for dispensing flowable material, such as adhesives, sealants, caulks and the like, onto a substrate and, more particularly, to a driver circuit for controlling operation of a solenoid-actuated valve within an electric dispensing gun.

BACKGROUND OF THE INVENTION

Electric liquid dispensing guns are designed to rapidly discharge droplets or strands of material onto a moving substrate, such as woven or non-woven fabrics, paper or other substrate materials. Dispensing guns of this type include a liquid passage that communicates between a pressurized liquid supply and a valve mechanism provided at the end of the liquid passage. The valve mechanism is typically a moveable plunger positioned to selectively obstruct a dispensing orifice formed in a valve seat. The plunger is extended and retracted relative to the valve seat in a controlled manner by a solenoid for providing repeatable and accurate dispense patterns of liquid material onto the substrate. It is important in the operation of the dispensing gun that the solenoid acts upon the plunger to quickly open and close the orifice when desired.

Dispensing systems have been developed that employ driver circuits to control operation of the solenoid within the dispensing gun. To open the valve, the driver circuit applies a fast pull-in current to the solenoid coil to quickly retract the plunger and open the dispensing orifice at the beginning of a dispense cycle. The driver circuit maintains a minimal holding current which holds the plunger in an open position while minimizing the amount of heat build-up in the solenoid coil during the dispense cycle. Finally, the driver circuit provides a fast demagnetization of the solenoid so the plunger is quickly closed upon the orifice at the end of the dispense cycle.

Closing of the plunger is generally achieved by a spring mechanism connected to one end of the plunger. When the solenoid is sufficiently demagnetized, the stored energy in the compressed spring mechanism forces the plunger to the closed position and in sealing engagement with the dispensing orifice. One example of such a dispensing system is set forth in U.S. Pat. No. 5,812,355, owned by the assignee of the present invention, the disclosure of which is incorporated herein by reference in its entirety.

Known electric dispensing guns and driver circuits have several drawbacks. In particular, current electric dispensing guns must typically quench the magnetic field in the solenoid before the plunger is forced to the closed position by the spring mechanism. The quenching time is dependent on the amount of energy stored in the solenoid's magnetic circuit and the voltage applied to the solenoid. All throughout the quenching process, the plunger is stuck in the retracted or open position until the solenoid is sufficiently demagnetized for the mechanical spring force to reposition the plunger to the closed position. The required quenching time of the solenoid's magnetic circuit reduces how quickly the orifice can be opened and closed, and thus, significantly affects the dispensing pattern that may be generated by the dispensing gun.

Accordingly, there is a need for an improved electric dispensing gun and driver circuit that reduces the time required to close an electric dispensing gun.

SUMMARY OF THE INVENTION

The present invention overcomes the foregoing and other shortcomings and drawbacks of electric dispensing guns and methods heretofore known. While the invention will be described in connection with certain embodiments, it will be understood that the invention is not limited to these embodiments. On the contrary, the invention includes all alternatives, modifications and equivalents as may be included within the spirit and scope of the present invention.

In accordance with the principles of the present invention, a solenoid operated liquid dispensing device and driver circuit for controlling operation of a solenoid-actuated valve within an electric dispensing gun are provided.

The solenoid operated liquid dispensing device includes a valve having a moveable plunger operative with a dispensing orifice. A solenoid is provided having an electrical coil and a moveable armature connected to the plunger for selectively positioning the plunger relative to the dispensing orifice to control flow of fluid through the orifice. A bidirectional current source is coupled to the solenoid coil for generating opposite magnetic fields in the coil in response to opposite current flow through the coil. In one direction of current through the solenoid coil, a magnetic field is generated by the coil and the armature is magnetized with a given magnetic polarity. A magnetic attraction is generated between the solenoid coil and the armature to retract the plunger from the orifice.

In an opposite direction of current through the solenoid coil, an opposite magnetic field is generated by the coil and the armature remains at least temporarily with the given magnetic polarity. This results in the generation of a magnetic repulsion between the solenoid coil and armature that forces the plunger toward the orifice and thereby accelerates the closing of the solenoid operated liquid dispensing device before the solenoid's magnetic circuit is demagnetized. The magnetic repulsion generated between the solenoid coil and the armature also reduces the closing time of the liquid dispensing device by assisting the closing force exerted by the spring mechanism.

The driver circuit includes a power supply having a positive output and a negative output. A plurality of switches are coupled between the positive and negative outputs of the power supply and the first and second terminals of the solenoid coil. Forward and reverse switch drivers are provided for establishing forward and reverse current paths between the first and second terminals of the solenoid coil by closing one or more of the switches. A solenoid current sensor is provided in the driver circuit to detect current passing between the first and second terminals of the solenoid coil.

A forward current circuit is operable to compare a current reference to the detected current from the solenoid current sensor. The forward current circuit generates a control signal to the forward switch driver for applying a forward current to the solenoid coil to approximate the current reference. A reverse current circuit is provided to compute a magnetic flux generated in the solenoid coil in response to the forward current. The reverse current circuit generates a control signal to the reverse switch driver for applying a reverse current to the solenoid coil to substantially demagnetize the solenoid's magnetic circuit and generate the magnetic repulsion between the solenoid coil and the armature.

The above features and advantages of the present invention will be better understood with reference to the accompanying figures and detailed description.

BRIEF DESCRIPTION OF THE DRAWINGS

Reference will now be made to the accompanying figures from which the novel features and advantages of the present invention will be apparent.

DETAILED DESCRIPTION OF THE PREFERRED EMBODIMENTS

Figure 1:
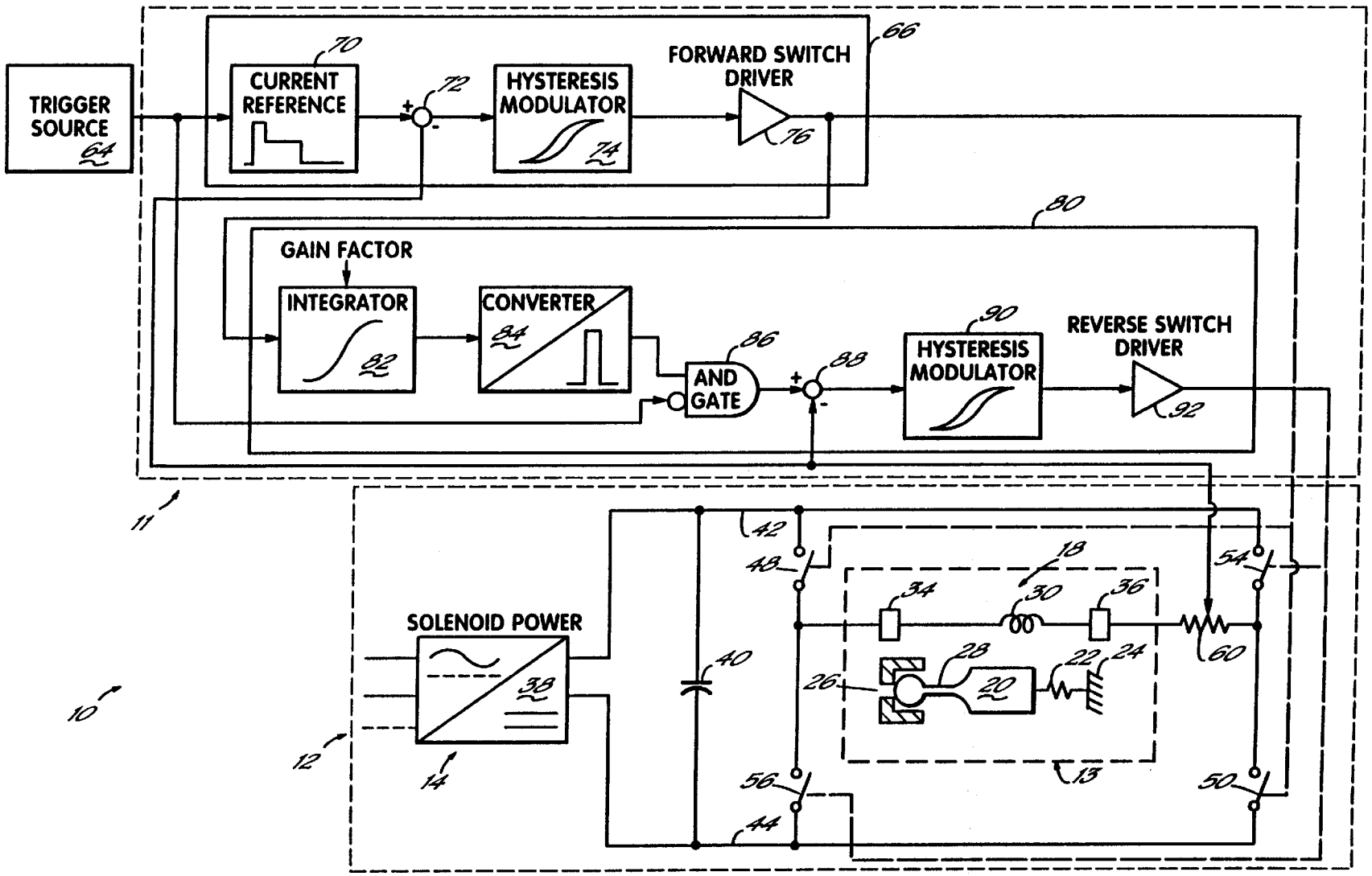
FIG. 1 is a schematic diagram of a driver circuit for controlling operation of a solenoid-actuated valve within an electric dispensing gun in accordance with the principles of the present invention.

Referring now to the figures, and to FIG. 1 in particular, an electric gun driver circuit 10 is shown in accordance with the principles of the present invention. Driver circuit 10 includes a control circuit 11 and a power circuit 12 for controlling operation of one or more electric dispensing guns of the type used to dispense adhesives, sealants, caulking and the like, represented diagrammatically at 13.

The power circuit 12 receives electrical power from a power supply 14. The electric dispensing gun 13 includes a solenoid 18 having a movable armature or plunger 20 to regulate the flow of liquid through the gun 13. The armature 20 is usually biased by a spring mechanism 22 that is connected between one end of the armature 20 and a fixed reference 24. The armature 20 is connected to a valve stem 28 that operatively cooperates with an orifice 26 in the electric dispensing gun 13. When the armature 20 is retracted against the force of spring mechanism 22, liquid within the gun 13 is permitted to flow under pressure through the orifice 26 onto a substrate that may move relative to the gun 13. As is well known in the art, the armature 20 is actuated by application of current through a coil 30 of the solenoid 18 wherein the coil has electrical properties modeled as resistance in series with inductance. The coil 30 is electrically accessible by first and second terminals 34, 36 that are selectively coupled to power supply 14 as described in detail below.

Line current is provided by power supply 14 which could be a battery, rectifier or other similar device. FIG. 1 shows an AC to DC converter 38 that is lowpass filtered by a capacitor 40 coupled across a power supply positive output 42 and negative output 44. These power supply outputs 42, 44 are connected to the first and second terminals 34, 36 of the solenoid 18 by switches 48, 50, 54 and 56 as described in detail below. Switches 48, 50, 54 and 56 may be insulated gate bipolar transistors (IGBT), although equivalent switches are contemplated.

A forward current path through solenoid coil 30 is generated when the third and fourth switches 54, 56 are open, and first switch 48 is closed connecting the first terminal 34 to the positive output 42 and second switch 50 is closed connecting the second terminal 36 to the negative output 44. A reverse current path through solenoid coil 30 is generated when the first and second switches 48, 50 are open, and third switch 54 is closed connecting the second terminal 36 to the positive output 42 and fourth switch 56 is closed connecting the first terminal 34 to the negative output 44. A shunt resistor 60 is coupled between the second terminal 36 of coil 30 and the second and third switches 50, 54. Shunt resistor 60 is provided to limit the current passing through coil 30 and to pass a proportion of the current to the control circuit 11 for closed loop sensing of the coil current as will be discussed in detail below.

The control circuit 11 receives a trigger signal, including an open and a close trigger signal, from a trigger source 64. A forward current circuit 66 of control circuit 11 is initiated by an open trigger signal from trigger source 64. Forward current circuit 66 includes a current reference 70, a forward summation node 72, a forward hysteresis modulator 74 and a forward switch driver 76. The forward summation node 72 compares a stored pull-in and hold-in current model stored in the current reference 70 to the sensed current from the shunt resistor 60, and generates a forward error signal which is hysteresis modulated at block 74 to command the forward switch driver 76 to close the first switch 48 and the second switch 50 as required. Thus, a positive forward error signal indicates that the sensed current is below the reference current stored in current reference 70, and the switches 48, 50 are closed to increase the forward current through solenoid coil 30. The switches 48, 50 will be briefly modulated as necessary to keep the sensed current from exceeding the current reference 70. Thus, the sensed current may have a saw-tooth form approximating the desired current reference 70.

During the time in which the forward current circuit 66 is actuating the solenoid 18, the reverse current circuit 80 is preparing for closing the electric gun 18. The output from the forward switch driver 76 is integrated by an integrator 82 and scaled by an appropriate gain factor for the rate at which the solenoid 18 generates magnetic flux when actuated. The power output by the integrator 82 is converted into a pulse of the same power by a converter 84. Thus, for a given power supply with the amplitude fixed, the pulse width will be modulated so that the pulse has energy approximating the magnetic flux of the solenoid 18. Therefore, when a close trigger signal is received from trigger source 64, the computed magnetic flux in the form of a pulse is applied to solenoid 18 to demagnetize the solenoid's magnetic circuit.

This is accomplished by providing the output of the converter 84 and the inverse of the trigger signal to an AND gate 86. The output of the AND gate 86 is compared to the sensed current from the shunt resistor 60 at a reverse summation node 88. To accommodate fluctuations in voltage and temperature while achieving the desired current, the output of the reverse summation node 88 is hysteresis modulated at block 90. Hysteresis modulator 90 provides an output to a reverse switch driver 92 that controls the third and fourth switches 54, 56. The close trigger signal from trigger source 64 also causes the forward current circuit 66 to open the first switch 48 and the second switch 50.

Figure 2:
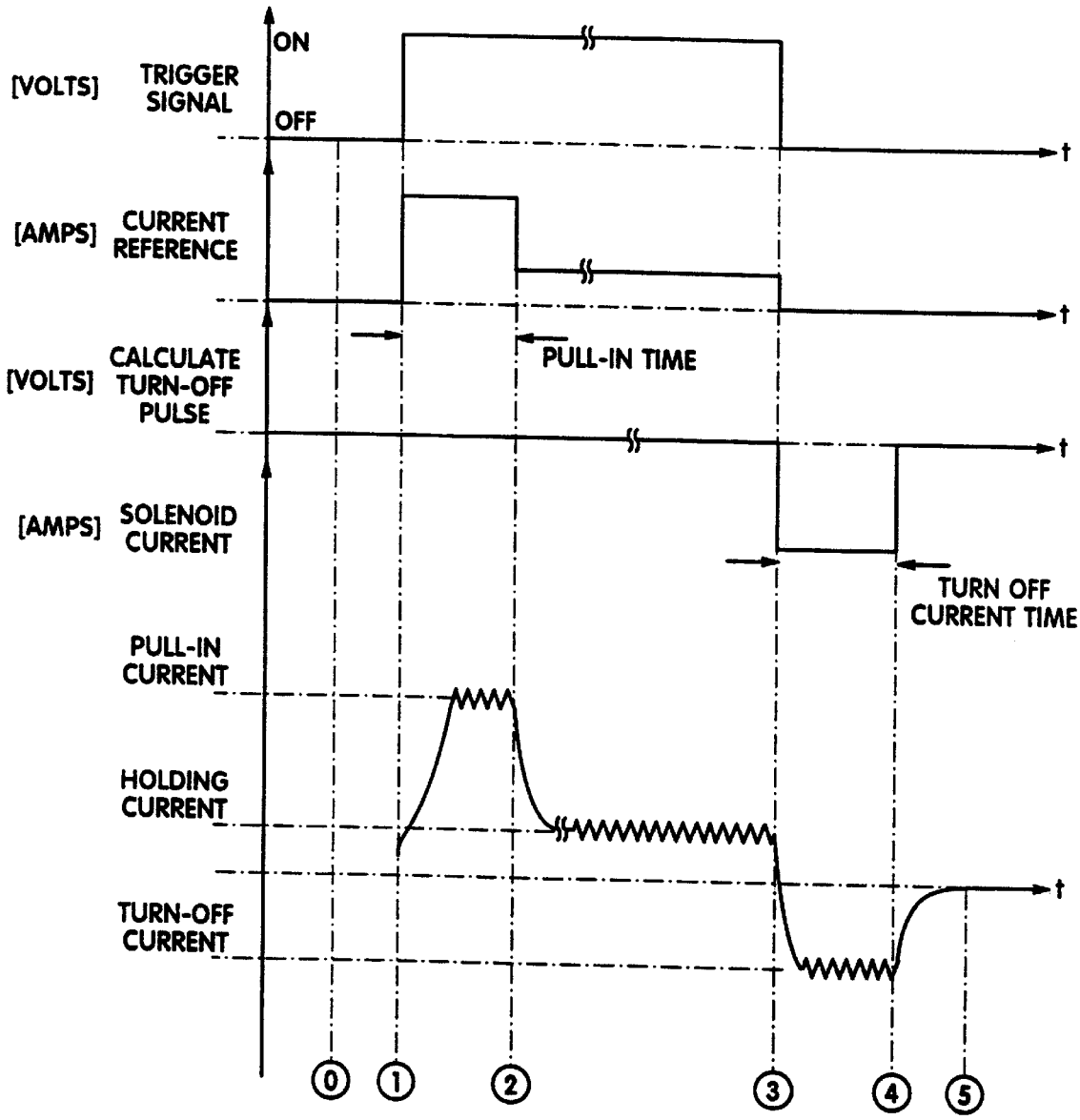
FIG. 2 illustrates voltage and current plots for the driver circuit and solenoid coil of FIG. 1.

As shown in FIG. 2, the electric gun driver circuit 10 is initially in a deactivated State 0 wherein the solenoid 18 has no coil current or magnetic field. At State 1, the control circuit 11 receives a trigger signal from trigger source 64 in the form of a rising edge of a pulse. The current reference 70 generates a coil current, initially at an amplitude corresponding to the desired pull-in current. Thus, the current of solenoid coil 30 achieves an approximation as shown following State 1. When a predetermined pull-in time is met, the current reference 70 reduces the applied current level at State 2 to a predetermined hold-in current level. At State 3, the trigger signal from trigger source 64 changes to a close trigger signal, causing the current reference to go to zero.

Between States 2 and 3, the integrator 82 and converter 84 calculate the magnetic flux that exists in solenoid 18 at the time of deactivation so that the appropriate reverse current may be applied to solenoid 18 to demagnetize the solenoid's magnetic circuit. Thus, at State 3, a calculated turn-off pulse as shown is applied to the reverse switch driver 92. The solenoid current approximates the corresponding turn-off current as shown. At State 4, the pulse width calculated by the converter 84 is met and the reverse coil current is turned off. At State 5, the solenoid 18 is deactivated and back to its initial state.

As one illustrative example of calculating a width-modulated pulse, an implementation for the integrator 82 and converter 84 would be the following equation:

$$t = \frac{N}{R} * \int_0^{\phi_\alpha} \frac{d\phi}{\left(\frac{E}{R} - I\right)}$$

wherein t is the time to reach the flux $\phi_\alpha$, for a pulse of normalized amplitude, N is the number of winding turns of the solenoid 18, R is the DC resistance of the solenoid winding 30, E is the applied voltage amplitude, and I is the applied current level, as indicated by the current feedback signal. Implicit in the above equation is that the flux $\phi_\alpha$ would be sensed or calculated, such as by the current feedback signal from the solenoid winding 30 multiplied by a predetermined gain factor obtained empirically or from a magnetic alloy chart. Of course, other alternative embodiments will be apparent to those skilled in the art.

Figure 3:
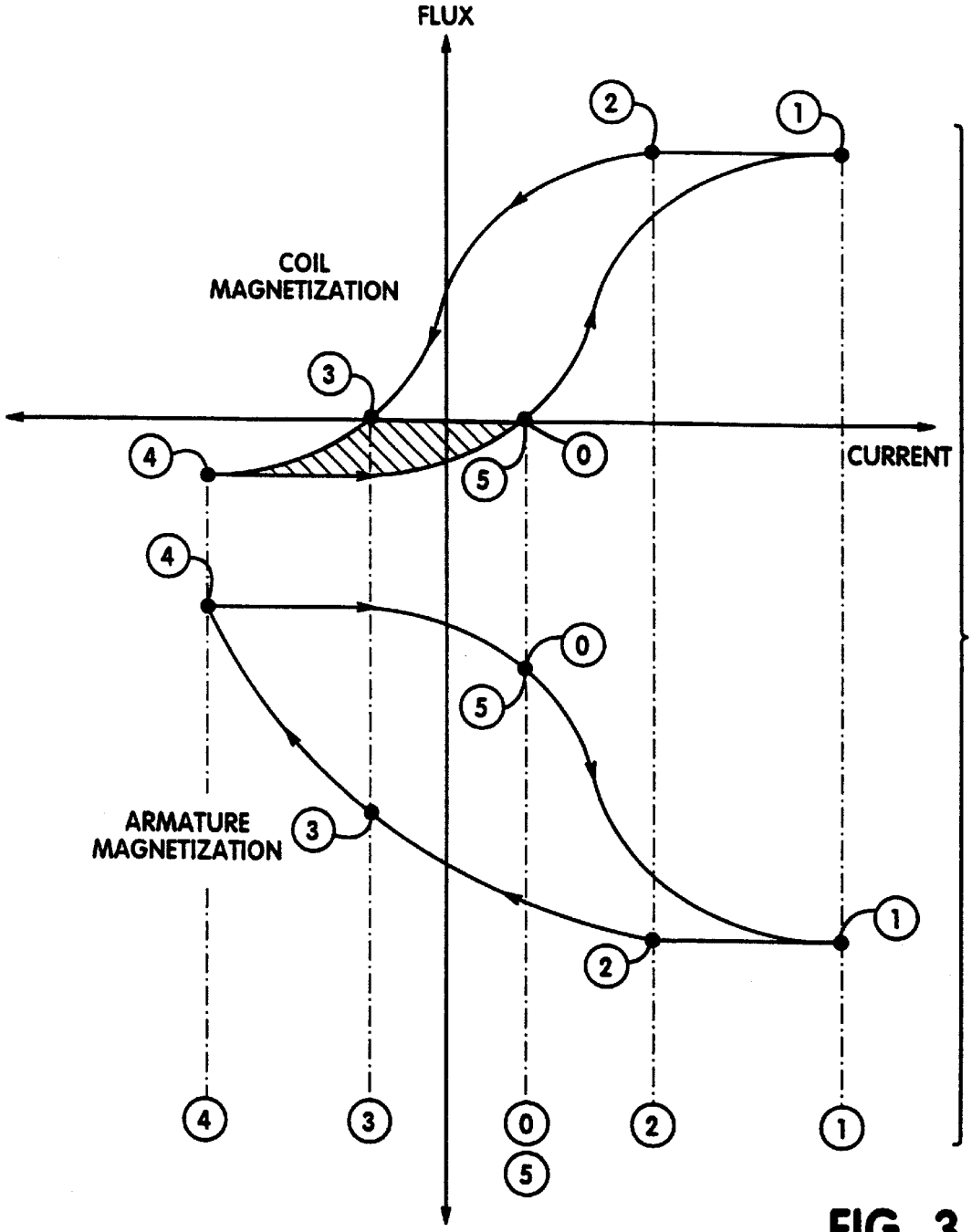
FIG. 3 illustrates magnetization curves of the solenoid coil and armature corresponding to the transition points shown in FIG. 2.

Referring to FIG. 3, the magnetization effect experienced in the coil 30 and armature 20 is shown corresponding to the transition points shown in FIG. 2. The coil 30 initially has no current and no magnetic field at State 0 and the armature 20 has not been magnetized. At State 1, the current increases in coil 30 with a corresponding increase in the coil magnetic field peaking at the point designated as State 1. This magnetic field induces an opposite current and magnetic field in the armature 20 peaking at the point for State 1. At State 2, the current and magnetic field in both the coil 30 and armature 20 roll off to hold-in values.

At State 3, the current reverses in coil 30 ending at the points designated State 4 meaning that the solenoid 18 is demagnetized quickly by the reverse current applied between States 3 and 4. Between States 3 and 4, the magnetic polarity of the coil 30 reverses so the magnetic polarities of coil 30 and armature 20 are at least briefly in time the same. The identical magnetic polarities in armature 20 and coil 30 results in a magnetic repelling force applied to the armature or plunger 20 that closes the valve stem 28 in sealing contact with orifice 26 before solenoid 18 is completely demagnetized. At State 4, coil 30 is deactivated when the magnetic remanence in armature 20 has essentially decayed.

With the solenoid 18 activated with either a pull-in or hold-in current applied to coil 30, opposite magnetic fields are induced in the armature 20 and coil 30. This results in the generation of a magnetic attraction force between armature 20 and coil 30 that retracts valve stem 28 from orifice 26. Between States 3 and 4, the magnetic field in solenoid 18 is reversed before the magnetic remanence in armature 20 has fully decayed. This results in the generation of a magnetic repelling force 102 between armature 20 and coil 30 that extends valve stem 28 into sealing contact with orifice 26.

Many of the components described herein lend themselves to digital implementation such as in a microprocessor. The current reference 70 can be a predetermined current characteristic for the specific application, including performance characteristics of the electric dispensing gun 13. In addition, the hysteresis modulators 74, 90, integrator 82, AND gate 86, and converter 84 also lend themselves to digital implementation within the microprocessor. The choice of pulse width modulating a steady state power supply 38 with switches 48, 50, 54, 56 also aids in digital implementation, although analog current sources could be readily substituted.

While the present invention has been illustrated by a description of a preferred embodiment and while this embodiment has been described in considerable detail, it is not the intention of the applicant to restrict or in any way limit the scope of the appended claims to such detail. For example, while one electric dispensing gun 13 is illustrated, those of ordinary skill in the art will appreciate that driver circuit 10 is adapted to control operation of multiple electric dispensing guns in a liquid dispensing environment. In addition, although separate switch drivers 66, 92 are shown controlling the four switches 48, 50, 54, 56, it should be appreciated that a number of switching means could be substituted, including various transistor switching methods, for example.

Additional advantages and modifications will readily appear to those skilled in the art. The invention in its broader aspects is therefore not limited to the specific details, representative apparatus and method, and illustrative examples shown and described. Accordingly, departures may be made from such details without departing from the spirit or scope of applicant's general inventive concept.

Having described the invention, I claim:

1. A solenoid operated liquid dispensing device, comprising:

a valve having a moveable plunger operative with a dispensing orifice;

a solenoid having an electrical coil and a moveable armature connected to said plunger for selectively positioning said plunger relative to said dispensing orifice to control flow of liquid through said orifice; and a bidirectional current source coupled to said solenoid coil for generating opposite magnetic fields in said coil responsive to opposite current flow through said coil;

whereby in one direction of current through said solenoid coil, a magnetic field is generated by said coil and said armature is magnetized with a predetermined magnetic polarity for generating a magnetic attraction therebetween to retract and hold said plunger from said orifice to permit liquid flow therethrough, and in an opposite direction of current through said solenoid coil, an opposite magnetic field is generated by said coil and said armature remains at least temporarily with said predetermined magnetic polarity to generate a magnetic repulsion therebetween to force said plunger toward said orifice to prevent liquid flow therethrough.

2. The dispensing device of claim 1 wherein said bidirectional current source includes a forward current circuit operable to provide a closed loop controlled forward current to said solenoid.

3. The dispensing device of claim 2 wherein said bidirectional current source includes a reverse current circuit operable to provide a closed loop controlled reverse current to said solenoid coil.

4. The dispensing device of claim 3 wherein said reverse current circuit is operable to calculate a magnetic flux generated in said solenoid coil by said forward current circuit.

5. The dispensing device of claim 4 wherein said reverse current circuit is operable to generate a reverse current through said solenoid coil to demagnetize said solenoid.

6. A driver circuit for controlling a solenoid of an electric liquid dispensing device, the liquid dispensing device including a coil having first and second terminals, a valve having a movable valving element for controlling the flow of liquid through a dispensing orifice in response to movement of said valving element, and a movable armature connected to said valving element, the driver circuit comprising:

a power supply having a positive output and a negative output;

a plurality of switches coupled between the positive and negative outputs of said power supply and said first and second terminals of said solenoid coil;

a forward switch driver operable to establish a forward current path between the first and second terminals of said solenoid coil by closing one or more of said switches;

a reverse switch driver operable to establish a reverse current path between the first and second terminals of said solenoid coil by closing one or more of said switches;

a forward current circuit operable to generate a control signal to said forward switch driver for applying a forward current to said solenoid coil to generate a magnetic field in said coil that retracts and holds the valve element from the dispensing orifice to permit liquid flow therethrough; and a reverse current circuit operable to generate a control signal to said reverse switch driver for applying a reverse current to said solenoid coil to generate an opposite magnetic field in said coil that forces the valve element toward the dispensing orifice to prevent liquid flow therethrough and substantially demagnetizes said solenoid.

7. The driver circuit of claim 6 further including a solenoid current sensor coupled to said forward current circuit and operable to detect current passing between said first and second terminals of said solenoid coil.

8. A driver circuit for controlling a solenoid of an electric liquid dispensing device, the liquid dispensing device including a coil having first and second terminals, a valve having a movable valving element for controlling the flow of liquid through a dispensing orifice in response to movement of said valving element, and a movable armature connected to said valving element, the driver circuit comprising:

a power supply having a positive output and a negative output;

a plurality of switches coupled between the positive and negative outputs of said power supply and said first and second terminals of said solenoid coil;

a forward switch driver operable to establish a forward current path between the first and second terminals of said solenoid coil by closing one or more of said switches;

a reverse switch driver operable to establish a reverse current path between the first and second terminals of said solenoid coil by closing one or more of said switches;

a solenoid current sensor operable to detect current passing between the first and second terminals of said solenoid coil;

a forward current circuit operable to compare a current reference to the detected current from said solenoid current sensor for generating a control signal to said forward switch driver to apply a forward current to said solenoid coil to generate a magnetic field in said coil that retracts and holds the valve element from the dispensing orifice to permit liquid flow therethrough; and a reverse current circuit operable to compute a magnetic flux generated in said solenoid coil in response to the forward current applied by said forward current circuit for generating a control signal to said reverse switch driver to apply a reverse current to said solenoid coil to generate an opposite magnetic field in said coil that forces the valve element toward the dispensing orifice to prevent liquid flow therethrough and substantially demagnetizes said solenoid.

9. A method for controlling a solenoid of an electric liquid dispensing device, the liquid dispensing device including a coil, a valve having a moveable valving element for controlling the flow of liquid through a dispensing orifice in response to movement of said valving element, and a moveable armature connected to said valving element, the method comprising:

providing current through said solenoid coil in one direction to generate a magnetic field in said coil and magnetize said armature with a predetermined polarity, thereby causing a magnetic attraction between said solenoid coil and said armature to retract and hold said valving element from said dispensing orifice to permit liquid flow therethrough; and providing current through said solenoid coil in an opposite direction to generate an opposite magnetic field in said coil while said armature remains at least temporarily with said predetermined polarity, thereby causing a magnetic repulsion between said solenoid coil and said armature to force said valving element toward said dispensing orifice to prevent liquid flow therethrough.

10. A method for controlling a solenoid of an electric liquid dispensing device, the liquid dispensing device including a coil, a valve having a moveable valving element for controlling the flow of liquid through a dispensing orifice in response to movement of said valving element, and a moveable armature connecting to said valving element, the method comprising:

applying current through said solenoid coil in one direction to generate a magnetic field in said solenoid coil that retracts and holds the valve element from the dispensing orifice to permit liquid flow therethrough;

calculating a magnetic flux generated in said solenoid coil in response to the applied current in said one direction, and applying current through said solenoid coil in an opposite direction to generate an opposite magnetic field in said coil that forces the valve element toward the dispensing orifice to prevent liquid flow therethrough and substantially demagnetizes said solenoid.

11. The method of claim 10 further including the step of magnetizing said armature with a predetermined polarity to generate a magnetic attraction between said solenoid coil and said armature to retract and hold said valving element from said dispensing orifice.

12. The method of claim 11 further including the step of generating an opposite magnetic field in said solenoid coil while said armature remains at least temporarily with said predetermined polarity to generate a magnetic repulsion between said solenoid coil and said armature to force said valving element toward said dispensing orifice.

* * * * *